United States Patent [19]

Russo

[11] 4,117,564

[45] Oct. 3, 1978

[54] OIL TANK CLEANING APPARATUS

[76] Inventor: Alberto Russo, 413 Waverley Ave., Mamaroneck, N.Y. 10543

[21] Appl. No.: 830,648

[22] Filed: Sep. 6, 1977

[51] Int. Cl.[2] ..... E04H 3/20

[52] U.S. Cl. ..... 15/1.7; 15/104.12; 15/387

[58] Field of Search ..... 15/1.7, 104.12, 387

[56] References Cited

U.S. PATENT DOCUMENTS

| | | | |
|---|---|---|---|
| 2,078,634 | 4/1937 | Karlstrom | 15/387 X |
| 2,332,940 | 10/1943 | Senke | 15/1.7 |
| 2,692,752 | 10/1954 | Heiss | 15/104.12 X |
| 3,341,880 | 9/1967 | Young | 15/1.7 X |
| 3,872,533 | 3/1975 | Proffit | 15/1.7 |

FOREIGN PATENT DOCUMENTS

| | | | |
|---|---|---|---|
| 38,834 | 6/1928 | Denmark | 15/387 |

*Primary Examiner*—Edward L. Roberts
*Attorney, Agent, or Firm*—Robert J. Eichelburg

[57] ABSTRACT

Oil tank cleaning appartus is disclosed comprising a rotary cutter rotatably mounted on a shaft and operatively connected to impellers to turn the cutter. A conduit is operatively connected to the cutter for leading a fluid away from the cutter. The cutter extends into edges that are pitched in a manner to propel the cutter and conduit when the cutter is rotated. When the cutter and conduit are immersed in an oil tank, oil drawn through the conduit will impinge against the impellers to turn the cutter and thereby provide the torque necessary to cause the cutter to move through sludge in the bottom of the oil tank, the sludge also being taken up through the conduit along with the oil.

The conduit may comprise a flexible conduit having a pair of opposed wires secured along the length thereof, the wires lying in a common plane to prevent the flexing of the conduit in a direction in which the plane extends.

The conduit and the cutter may be mounted on a hollow housing having a plurality of openings positioned next adjacent the cutter, the openings being covered by a cap that partially blocks the openings so that when employed as apparatus for removing sludge from an oil tank the bottom openings are uncovered and the top openings are covered. The cap may comprise a rotary shield having a weight extending therefrom so as to position the shield above the center of gravity of the weight.

7 Claims, 5 Drawing Figures

OIL TANK CLEANING APPARATUS

SUMMARY OF THE INVENTION

The present invention relates to apparatus comprising a rotary cutting member for rotatably penetrating a surface. The cutter is rotatably mounted on a shaft member for rotating the cutter. Impeller members are operatively associated with the cutter for rotating the cutter. A conduit member is operatively connected to the cutter for leading a fluid away from the cutter.

The cutter further comprises edge members extending therefrom, the edges being adapted to cut through a surface and also being pitched sufficiently to propel the cutter and the conduit as the cutter is rotated.

The conduit may comprise a flexible conduit having opposed flexible wire members mounted thereon, the wires lying in a common plane to prevent the conduit from being flexed in the direction in which the plane extends. The conduit may extend through a substantially rigid tube member for changing the direction in which the conduit projects.

The cutter and the conduit may be operatively connected to a hollow housing, opening members being provided in the housing next adjacent the cutter for leading a fluid from the cutter to the conduit. The openings may have a cap member thereon for partially blocking the openings.

The cap may comprise a rotary shield mounted on an axle to partially block the openings. A weight member extends from the shield below the axle to position the shield above the center of gravity of the weight.

The impellers may be mounted on the shaft for applying torque to the shaft and the conduit may be operatively associated with the cutters and the impellers to lead fluid away from the cutters to impinge against the impeller and thereby apply torque to the shaft.

DETAILED DESCRIPTION

Figure 2:
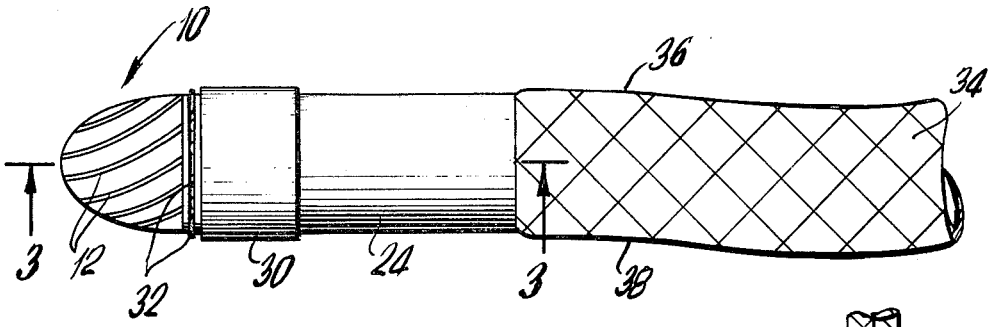
FIG. 2 comprises a plan view of rotary cutting apparatus having a flexible conduit extending from the housing, wires being mounted on either side of the flexible conduit and lying in a common plane to prevent the flexible conduit from being flexed in a direction in which the plane extends.
Figure 3:
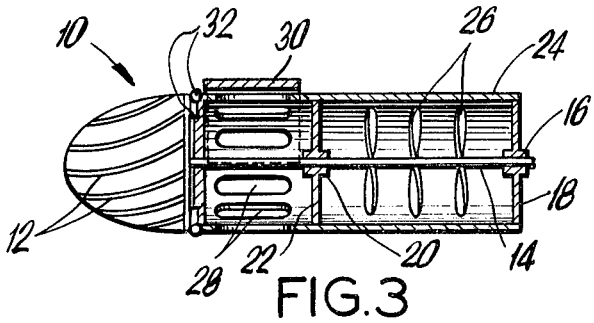
FIG. 3 comprises a side elevation in section taken along the line 3—3 of FIG. 2 of a rotary cutter mounted on a shaft extending from a hollow housing, the shaft having impellers thereon and the housing having openings and an adjustable cap over the openings.

Fluid driven cleaning devices are disclosed in the prior art U.S. Pat. Nos. to Proffit, 3,872,533; Foster, 3,790,979; Wright, 3,471,884 and Watson, 3,229,315.

The patent to Wright teaches a rotary brush driven by an impeller which is caused to rotate by water being drawn over the surface of the impeller by means of a pump. The Wright apparatus is employed for cleaning the walls of a swimming pool and has to be positioned by hand on the walls of the pool in order to effectively clean any surfaces against which it is pressed.

None of the foregoing references describe apparatus which may be effectively employed for removing sludge from an oil tank which has to be cleaned periodically. The sludge comprises a thick or viscuous mass that accumulates in the bottom of an oil tank and if not removed will clog the feed lines leading therefrom either to an oil burner or other device to which the tank is connected such as an industrial engine and the like. Additionally, the foregoing references do not describe apparatus that would assist the cutting device to not only break up the sludge for removal through a conduit but also do not disclose apparatus that would assist in propelling the cutting device through the sludge.

It is therefore an object of the present invention to overcome these and other difficulties encountered in the prior art.

It is a further object of the present invention to provide apparatus for removing sludge from the bottom of an oil tank.

It is also an object of the present invention to provide a rotary cutting device for penetrating a surface and which is also self-propelled.

It is a further object of the present invention to provide a flexible conduit having a plane passing therethrough and which can be flexed in any direction except in the direction in which the plane extends, the conduit being operatively associated with the aforementioned cutting apparatus for leading a fluid away from the cutting apparatus.

These and other objects have been achieved according to the present invention and will become apparent by reference to the disclosure and claims that follow as well as the appended drawing.

Referring to the drawing and FIGS. 1–5 therein, a rotary cutter 10 is illustrated having cutting edges 12 extending from the surface thereof, cutting edges 12 being pitched to propel the cutter 10 when the cutter is rotated. Cutter 10 is mounted on a shaft 14 which rotates on bearings 16 and 20, the latter being secured by bearing mounting rods 18 and 22 secured to the inside wall of a hollow housing 24. Impeller blades 26 extend from the shaft 14 and are arranged to rotate within the housing 24. A plurality of openings 28 are provided at one end of the housing 24 and a cap 30 is arranged to seal off some of the openings 28. Roller bearings 32 are positioned at one end of the housing 24 in order to assist the apparatus to roll along the floor of an oil tank when it is employed for the removal of sludge from such a tank. The housing 24 is connected to a flexible hose 34 having a pair of wires 36 and 38 secured to the sides of the hose 34, wires 36 and 38 lying in a common plane to prevent the flexible hose 34 from being turned in the direction in which the plane lies.

Figure 4:
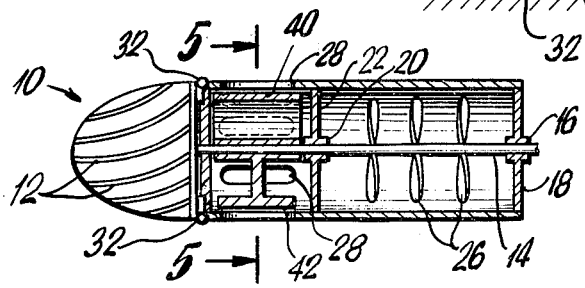
FIG. 4 comprises a side elevation in section of apparatus substantially as described with respect to FIG. 3 with the exception that a rotary shield is provided in lieu of the cap, the rotary shield having a weight thereon to position the shield above the center of gravity of the weight.
Figure 5:
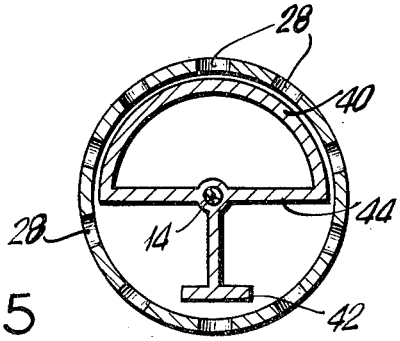
FIG. 5 comprises a front elevation in section taken along the line 5—5 of FIG. 4.

In a further embodiment, as illustrated in FIGS. 4 and 5, a rotary shield 40 is employed in lieu of the cap 30, shield 40 being pivotally mounted on shaft 14 by means of a planar plate 44 connecting the terminal ends of the shield 40. A weight 42 extends from the plate 44 to position the shield above the center of gravity of the weight.

Figure 1:
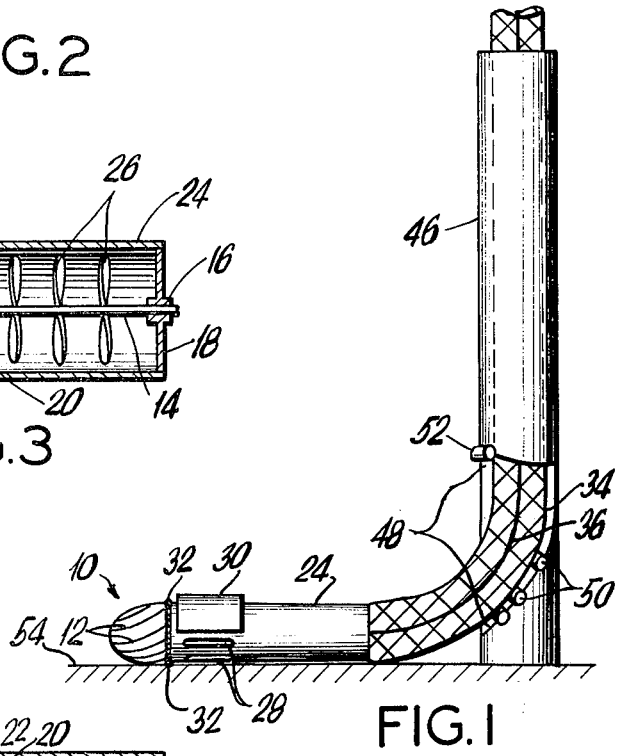
FIG. 1 comprises a side elevation in section of rotary cutting apparatus partly in section attached to a flexible conduit having opposed wires on either side thereof and projecting from a tube to control the direction of the rotary cutter flexible conduit combination.

Referring to FIG. 1, a tube 46 having an opening 48 therein is provided, roller bearings 50 and 52 being positioned in the tube 46 to assist the rotary cutting apparatus of the present invention to pass out of the opening 48 and along the floor 54 of an oil tank in which the tube 46 is positioned.

In use, the rotary cutting apparatus is positioned as is illustrated in FIG. 1 through a tube 46 and is arranged to move along the floor 54 of an oil tank. In this respect it is important to note that the wire 36 and 38 (not shown) in FIG. 1 are positioned so that the rotary cutting apparatus is caused to move in an upward and a downward direction but cannot be moved from left to right unless the tube 34 is turned. This feature allows the rotary cutting apparatus to be steered along the bottom of the oil tank 54 from ground level during the cleaning operation. Because the sludge in the bottom of an oil tank is a thick or viscous mass rotation of the cutter head 10 and the cutting edges 12 extending therefrom will cause the cutter head 10 to bore through the sludge and pull the cutting apparatus and the hose 34 through the sludge. The cutter head 10 is caused to rotate by pumping the sludge or mixture of fuel oil and sludge upwardly through the hose 34 and out of the tank so that the flow of the sludge and oil is through the openings 28 and over the impeller blades 26 in housing 24. Prior to the insertion of the cutting apparatus into the tank, the cap 30 is positioned so that the openings 28 will be unsealed in the bottom or floor 54 of the tank and the openings at the top of the tank will be sealed by the cap.

In order to evenly distribute the wear due to flexing of the hose 34 during these various cleaning operations, it is periodically rotated 180° after being withdrawn from the tank through the tube 46 and the cap 30 is similarly rotated 180° thereby reversing the flexing distortion that may be placed on the hose in order to extend hose life.

As an alternate embodiment, a rotary shield 40 may be employed in lieu of the cap 30, rotary shield 40 being mounted inside of housing 24 on the shaft 14 through the mounting plate 44 which freely rotates on the shaft 14. As the cutting head 10 rotates and has a tendency to twist or change the positions of the openings 28 relative to the bottom of an oil tank 54, the weight 42 will automatically reposition the shield 40 so that the shield 40 will always lie normal to the center of gravity of the weight 42 thereby closing the openings that are facing upwardly.

Although the invention has been described by reference to some embodiments, it is not intended that the novel apparatus be limited thereby but that modifications thereof are intended to be included as falling within the broad spirit and scope of the foregoing disclosure, the following claims and the appended drawing.

What is claimed is:

1. Apparatus comprising rotary cutting means for rotatably penetrating a surface, conduit means associated with said cutting means, said cutting means being rotatably mounted on shaft means, said cutting means having edge means extending therefrom and adapted to cut through a surface, said edge means being pitched sufficiently to propel said cutting means and said conduit means as said cutting means is rotated, impeller means operatively associated with said cutting means for rotating said cutting means, said conduit means being arranged to cause a fluid to impinge against said impeller means and thereby rotate said impeller means, said shaft means being mounted in a hollow housing, said conduit means operatively connected to said housing, opening means being provided in said housing next adjacent said cutting means for leading a fluid from said cutting means to said conduit means, said opening means having cap means thereon for partially blocking said opening means said cap means being movable on said housing to change the location of said opening means which may be blocked by said cap means.

2. The apparatus of claim 1 where said conduit means comprises a flexible conduit having opposed flexible wire means mounted thereon, said wire means lying in a common plane to prevent said conduit means from being flexed in the direction in which said plane extends and for allowing said conduit to be flexed in a direction substantially transverse to the direction in which said plane extends.

3. The apparatus of claim 1 where said conduit means extends through substantially rigid tube means having conduit influent and conduit effluent openings arranged for changing the direction in which said conduit projects.

4. The apparatus of claim 2 where said conduit means extends through substantially rigid tube means for changing the direction in which said conduit projects.

5. The apparatus of claim 1 where said cap means comprises rotary shield means mounted on an axle to partially block said opening means, weight means extending from said shield means below said axle to position said shield means above the center of gravity of said weight means.

6. The apparatus of claim 1 where said impeller means are mounted on said shaft means for applying torque to said shaft means.

7. The apparatus of claim 6 where said conduit means is operatively associated with said cutting means and said impeller means to lead a fluid away from said cutting means and to impinge against said impeller means to apply torque to said shaft means through said impeller means.

* * * * *